US007063027B2

(12) United States Patent
O'Connor

(10) Patent No.: US 7,063,027 B2
(45) Date of Patent: Jun. 20, 2006

(54) AIR CURTAIN INCINERATOR

(75) Inventor: Brian M. O'Connor, Palm City, FL (US)

(73) Assignee: Air Burners LLC, Palm City, FL (US)

( * ) Notice: Subject to any disclaimer, the term of this patent is extended or adjusted under 35 U.S.C. 154(b) by 0 days.

(21) Appl. No.: 10/910,886

(22) Filed: Aug. 4, 2004

(65) Prior Publication Data

US 2006/0027150 A1 Feb. 9, 2006

(51) Int. Cl.
*F23G 5/00* (2006.01)
*F23B 7/00* (2006.01)

(52) U.S. Cl. ..... 110/346; 110/185; 110/233; 110/241

(58) Field of Classification Search ..... 110/185, 110/186, 190, 346, 240, 241, 233
See application file for complete search history.

(56) References Cited

U.S. PATENT DOCUMENTS 3,561,377 A * 2/1971 Amundsen ..... 110/190
3,785,302 A * 1/1974 Davis ..... 110/215
4,360,336 A * 11/1982 Shepherd ..... 431/12
4,756,258 A 7/1988 Gilbert
5,415,113 A * 5/1995 Wheeler et al. ..... 110/241

OTHER PUBLICATIONS

Air Burners, LLC—Operating Manual for the Air Burners S-300E Series (Electric Drive) Air Curtain Burners, Mar. 19, 2003.

* cited by examiner

*Primary Examiner*—Kenneth Rinehart
(74) *Attorney, Agent, or Firm*—Hodgson Russ LLP

(57) ABSTRACT

A self-contained, transportable air curtain incinerator for combustion of low calorific value waste comprises a transportable frame supporting a firebox, a fuel supply tank, a fuel-burning electric power generator in communication with the fuel supply tank, at least one fuel-burning burner unit in communication with the fuel supply tank for directing a flame into a combustion chamber defined by the firebox, and an air curtain blower powered by the generator for providing a sheet of high velocity air flow generally across an open top of the firebox.

15 Claims, 6 Drawing Sheets

AIR CURTAIN INCINERATOR

FIELD OF THE INVENTION

The invention relates to the field of waste disposal, and in particular waste disposal by incineration.

BACKGROUND OF THE INVENTION

Incinerating waste is a known alternative to burying waste or transporting it to another location. In order to reduce ash and smoke released during waste incineration (particulate release), a flow of high velocity air has been used to provide an "air curtain" over a fire pit or firebox in which the waste is burned. U.S. Pat. Nos. 4,756,258 and 5,415,113 describe portable apparatus for air curtain incineration. The former patent teaches a fan and manifold assembly that can be located at the edge of a fire pit, such as may be found at a landfill site. The latter patent teaches a firebox, fan, and manifold assembly mounted on a support frame for transport to a desired site, for example a development site where vegetation is being cleared, for incineration of waste without the need to dig a fire pit. These solutions are suitable for applications where there is ample supply of supplemental wood waste to fuel combustion, or where the disposal waste itself has high calorific value. However, in situations where supplemental wood waste is scarce and the disposal waste will not readily burn on its own, these solutions tend to be inefficient because it is difficult to maintain high combustion temperatures.

SUMMARY OF THE INVENTION

It is therefore an object of the present invention to provide a portable air curtain incinerator for efficiently and cleanly burning low calorific waste in locations where wood waste is scarce or unavailable to supplement combustion.

It is another object of the present invention to provide an air curtain incinerator that is self-contained and requires little or no set up time.

It is a further object of the present invention to provide an air curtain incinerator having on-board power generation and automated controls.

In furtherance of these objects, an incinerator apparatus embodying the present invention generally comprises a portable frame and a firebox, fuel supply tank, fuel-burning generator, at least one fuel-burning burner unit, and air curtain means all supported on the frame. The firebox occupies most of the frame and includes rear doors for loading waste material into a combustion chamber defined by the firebox. The fuel supply tank and generator are housed in a control room at a front end of the frame. Preferably, two burner units are mounted on the firebox and connected to the fuel supply tank, with one burner unit being located adjacent or near the control room and the other being located remotely from the control room (i.e. near the rear of the firebox) to direct flame into the combustion chamber. The air curtain means includes an electric fan powered by the generator and arranged to feed air to an air curtain manifold assembly extending along a sidewall of the firebox to direct a sheet of high velocity air flow generally across an open top of the firebox.

In a preferred embodiment, each burner unit has an automatic fuel injector regulating flow of fuel to the burner unit, and a controller in the control room signals each fuel injector to control output intensity of the associated burner unit. The controller may be connected to feedback sensors monitoring combustion temperature and/or particulate release so that burner unit intensity is automatically adjusted to maintain predetermined conditions.

The invention also encompasses a method of incinerating waste comprising the steps of A) providing a firebox, at least one fuel-burning burner unit for directing a flame into the firebox, and air curtain means for providing a sheet of high velocity air flow over a top opening of the firebox; B) loading the firebox with waste; C) activating the at least one burner unit until waste combustion is sustainable without energy from the at least one burner unit, and then deactivating the at least one burner unit to allow waste combustion to proceed on its own; D) activating the air curtain means; E) monitoring particulate release from the waste combustion; F) reactivating the at least one burner unit if particulate release rises above an acceptable range, and then G) deactivating the at least one burner unit when particulate release is in the acceptable range. The step of monitoring particulate release can be performed visually using the Ringlemann smoke scale, or by one or more opacity sensors.

BRIEF DESCRIPTION OF THE DRAWINGS

The nature and mode of operation of the present invention will now be more fully described in the following detailed description taken with the accompanying drawing figures, in which.

DETAILED DESCRIPTION OF THE INVENTION

Figure 1:
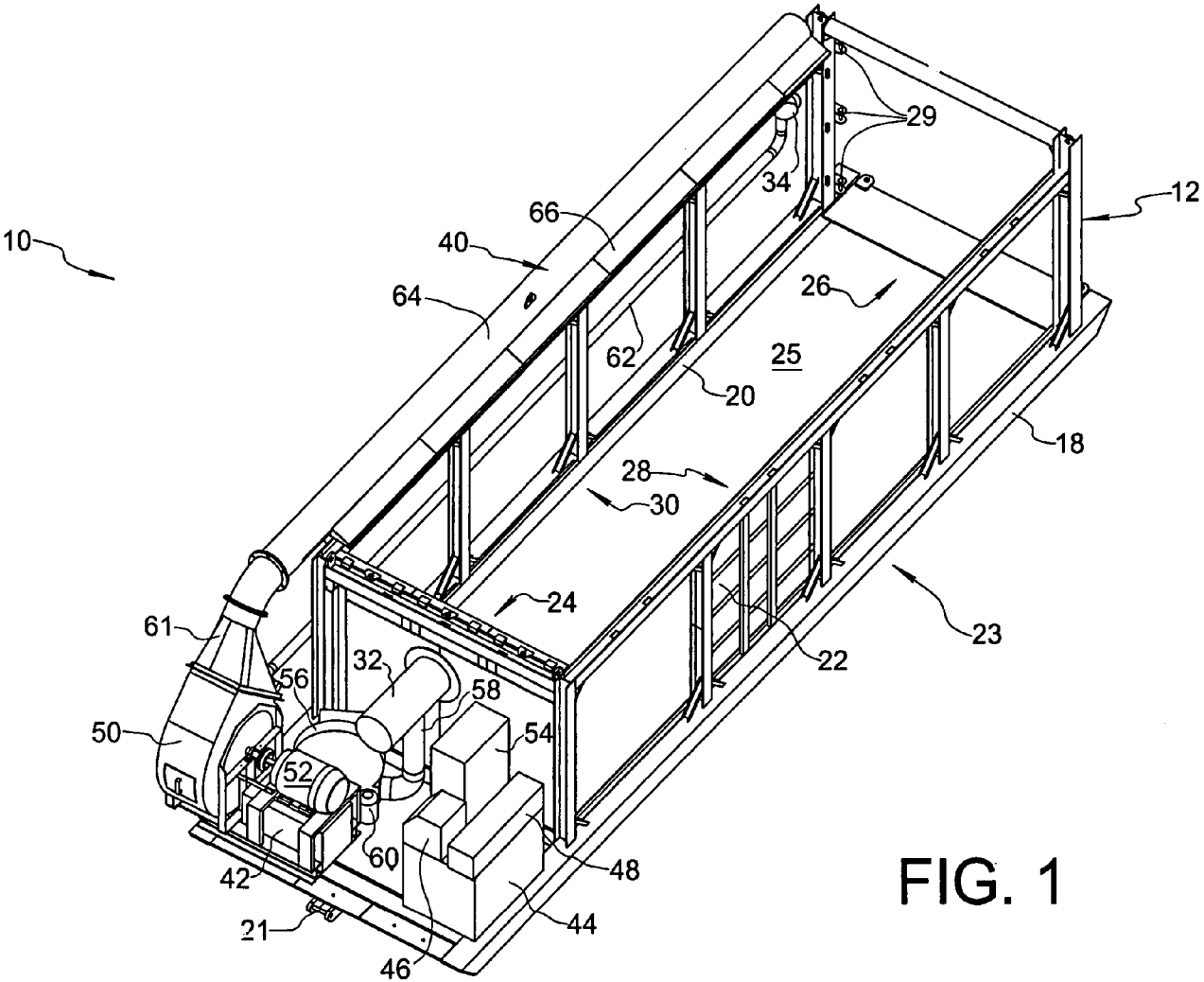
FIG. 1 is a perspective view of an air curtain incinerator formed in accordance with an embodiment of the present invention, with a control room of the incinerator being exposed to view.

FIGS. 1–4 illustrate a self-contained air curtain incinerator 10 formed in accordance with an embodiment of the present invention. Air curtain incinerator 10 is designed for incinerating waste, particularly low calorific value waste, at sites where electric and gas utilities are either non-existent or are not dependable. For example, the present invention is suited for use in remote and/or temporary military installations, and in third-world countries where waste disposal infrastructure is lacking.

Incinerator 10 is built upon an elongated structural steel frame 12 having a front end generally designated as 14 and a rear end generally designated as 16. A pair of longitudinally extending, laterally spaced skids 18 and 20 contact the ground so that incinerator 10 may be dragged from one location to another nearby location using one or more tow couplings 21 provided at front end 14.

Frame 12 comprises upstanding rectangular openings for receiving sets of thermo-ceramic panels 22 to provide a front wall 24, a pair of sidewalls at 28 and 30, and rear doors at 26 hung on hinges 29. Only one set of panels 22 is shown in the figures for sake of clarity. In this manner, a firebox generally designated 23 having an open top is supported on frame 12 and, with the cooperation of the ground, defines a combustion chamber 25 for receiving waste to be burned. Accordingly, the firebox is adjacent rear end 16 such that loading of waste can take place through rear doors indicated symbolically at 26. A more detailed description of a generally suitable frame and firebox construction can be found in commonly owned U.S. Pat. No. 5,415,113 at column 4, line 3–column 5, line 5, the description found there and associated figures being incorporated herein by reference.

Adjacent the front end 14 of frame 12, ahead of the front wall 24 of the firebox 23, is a control room generally identified by reference numeral 19. Control room 19 abuts with firebox front wall 24 and includes a front control room wall 68, a pair of control room sidewalls 70, a control room roof 72, and a control room door 74. Housed within control room 19 is a fuel tank 42 and a generator 44 connected to the fuel tank and providing electric power to various systems of the incinerator 10 described below. The fuel tank is preferably a sixty-nine gallon tank storing diesel fuel burned by generator 44, while generator 44 is preferably a diesel-powered 70 kW, 460 volt, three-phase, 60 Hz generator. A fuel line coupling 80 is provided externally of control room 19 for connecting a fuel supply line (not shown) running from an outside fuel source, such as a tanker truck. It is advantageous that fuel tank 42 be equipped with dual electronic level indicators (not shown) for feedback to the fuel source and to an overflow valve to prevent damage to the fuel tank from the outside source.

Figure 2:
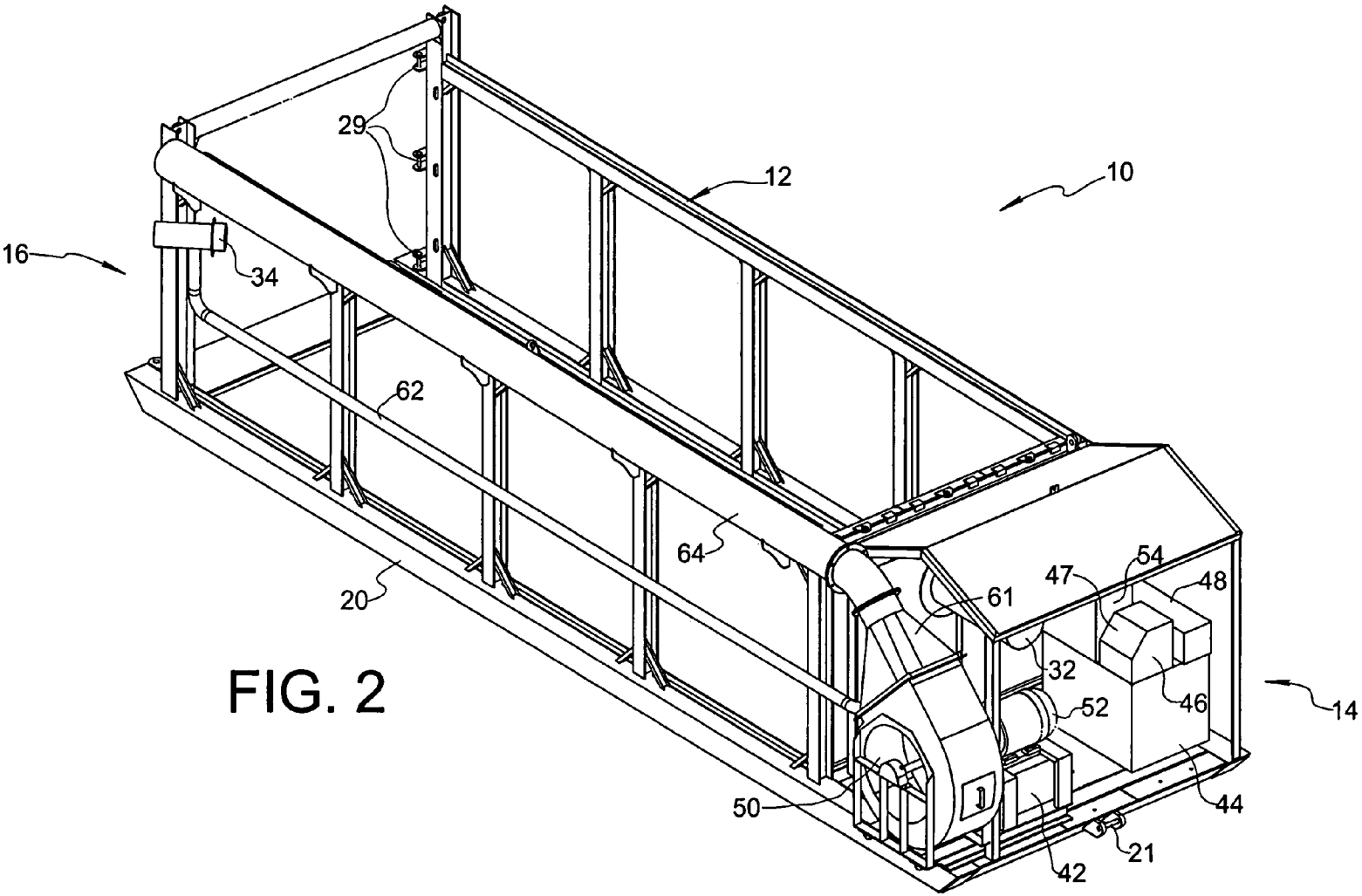
FIG. 2 is another perspective view of the air curtain incinerator shown in FIG. 1.
Figure 3:
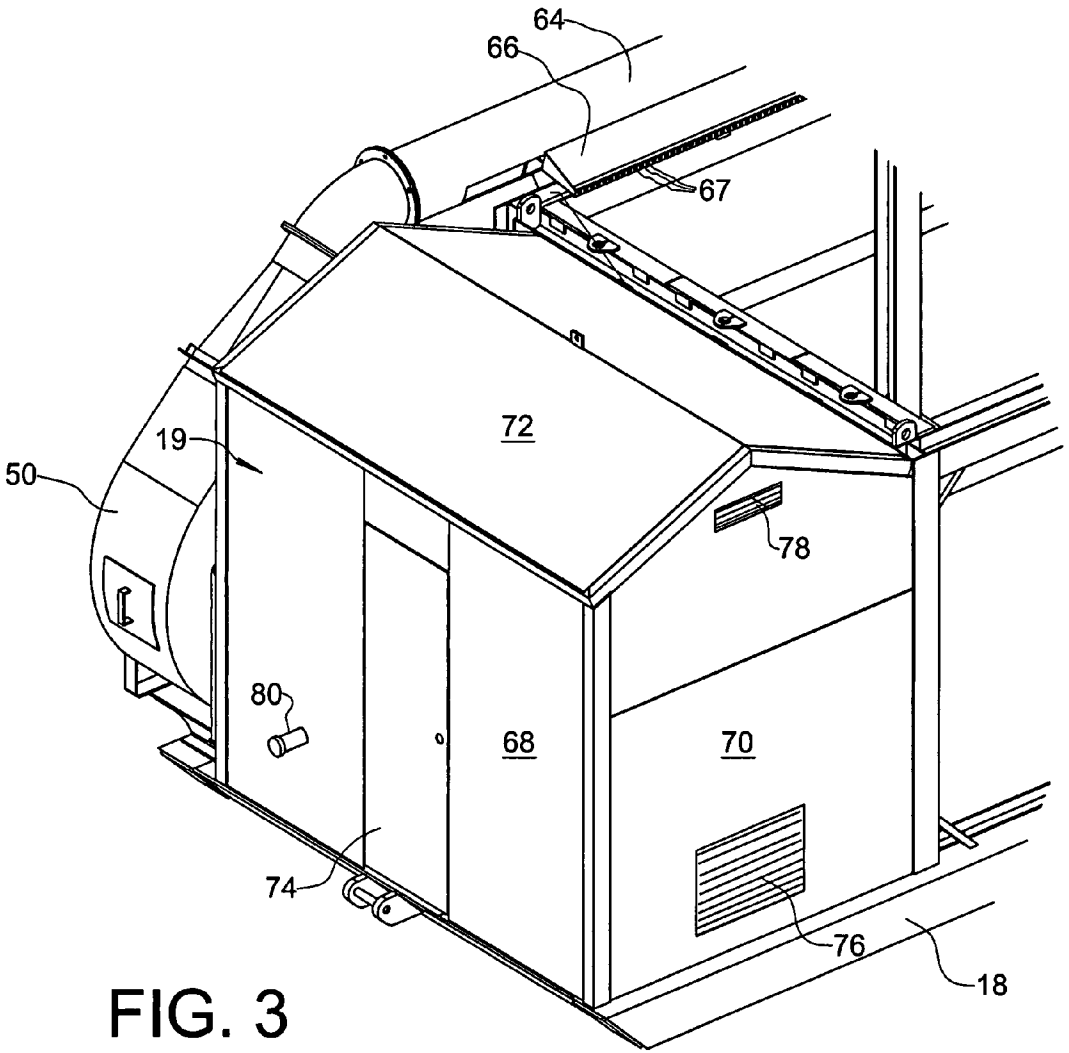
FIG. 3 is a perspective view of a control room enclosure of the air curtain incinerator.

One of the systems powered by generator 44 is air curtain means 40 for providing a sheet of high velocity airflow generally across the open top of firebox 23. As seen in FIGS. 1 and 2, air curtain means 40 includes an air curtain fan 50, a transfer nozzle 61 channeling a flow of air from air curtain fan 50, and a generally tubular manifold assembly 64 receiving air flow from transfer nozzle 61. Manifold assembly 64 extends the length of firebox 23 along the top of sidewall 30 and has a linear array 66 of nozzles 67 directed into firebox 23. Transfer nozzle 61, manifold assembly 64, and the array 66 of nozzles 67 can be constructed generally as taught in the aforementioned U.S. Pat. No. 5,415,113 at column 5, line 43–column 6, line 11 and at column 6, lines 36–63, the description provided there and associated figures being incorporated herein by reference. Air curtain fan 50 is driven by an electric motor 52 energized by a motor drive controller 54 connected to receive power from generator 44. In a preferred embodiment, motor 52 is a seventy-five horsepower AC motor and motor drive controller 54 is a variable frequency drive incorporating safety features such as over temperature protection, over speed protection, and current overload protection. A three-speed motor drive is suitable and results in a desirably simple operator interface.

Figure 4:
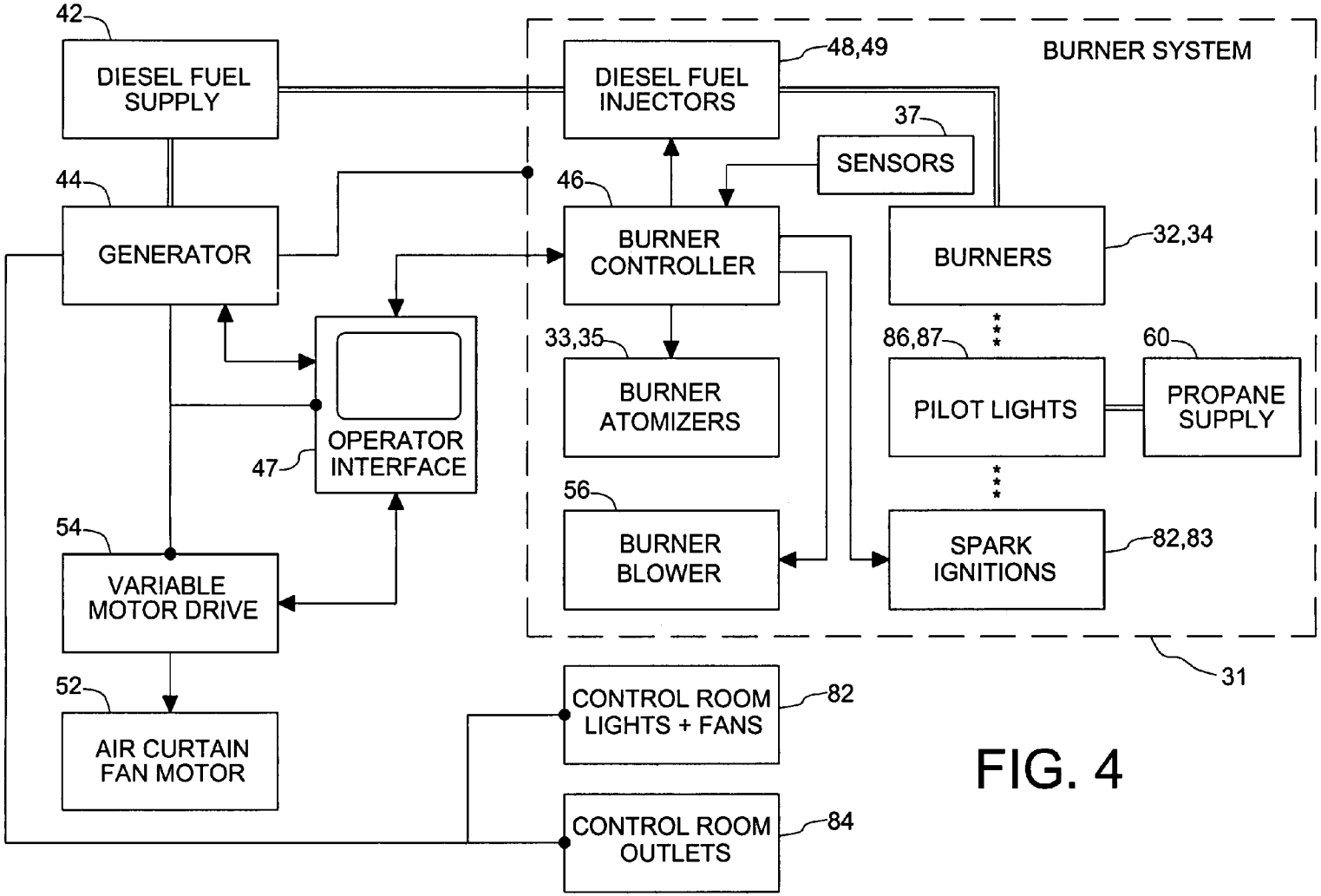
FIG. 4 is a schematic system diagram of the air curtain incinerator.

Reference is also made now to FIG. 4 of the drawings. Incinerator 10 further comprises a burner system 31 powered by generator 44, wherein burner units of the burner system are chosen to burn fuel from fuel tank 42. In a preferred embodiment, the burner system includes a front burner unit 32 mounted on firebox front wall 24 and a rear burner unit 34 mounted on firebox sidewall 30 at a location remote from control room 19, with both burner units orientated to direct their output flames into combustion chamber 25. In the embodiment described herein, front burner unit 32 is preferably a six-million BTU diesel burner, such as the "BBC 1108 Beta Burner" manufactured by Hauck Manufacturing of Lebanon, Pa., while rear burner unit 34 is preferably a two-million BTU diesel burner also made by Hauck Manufacturing. The burner units can be baffle-type burner units burning clean industrial No. 2 diesel fuel oil. The burner units 32 and 34 have respective fuel injectors 48 and 49, burner atomizers 33 and 35, spark ignitions 82 and 83, and pilot lights 86 and 87 controlled by a digital burner controller 46, such as the Hauck Model BCS-3000J. The burner controller 46 also runs burner blower 56, which communicates with front burner unit 32 by way of a duct 58 and with rear burner unit 34 by way of a pipeline 62 arranged to run along the exterior of firebox sidewall 30 just below and parallel to air curtain manifold assembly 64. A propane igniter tank 60 in control room 19 is connected to the pilot lights 86 and 87 of front and rear burner units 32 and 34 by gas lines (not shown). Electrical wiring is housed in pipeline 62 for connecting burner controller 46 with rear burner unit 34. Also, a fuel line runs within pipeline 62 to deliver fuel from fuel tank 42 to rear burner unit 34, and a gas line runs within pipeline 62 to deliver propane from igniter tank 60 to pilot light 87 of rear burner unit 64. Pipeline 62 is suitably constructed of welded schedule 40 steel pipe.

Sensors 37, indicated schematically in FIG. 4, are arranged proximate to combustion chamber 25 and burner units 32 and 34 to provide feedback signals to the digital burner controller 46. More specifically, temperature sensors arranged to measure combustion temperatures and/or opacity sensors arranged to measure particulate release may be used to provide signals to the digital burner controller 46, wherein the burner controller can be programmed to control burner units 32 and 34 to maintain a predetermined temperature range and/or particulate release limit. Ultra-violet radiation sensors near the burner units 32 and 34 are preferably provided to verify burner ignition during start up.

An operator interface 47 powered by generator 44 is provided within control room 19. As shown in FIG. 4, operator interface 47 communicates with generator 44, burner controller 46, and motor drive 54. Operator interface 47 is intended to be simple in design. According to one embodiment, interface 47 includes a one button start switch, a voltage meter, and an ampere meter for generator 44; a keypad and a digital readout for burner controller 46; and an on/off button and a three-speed selector switch for motor drive 54 to control the speed of air curtain fan motor 52.

Control room 19 also houses lights and fans 90, and power outlets 92 for connecting auxiliary electrical devices to generator 44.

A general procedure for operating air curtain incinerator 10 to burn waste will now be described with reference to flow diagram shown in FIG. 5. Generator 44 is started in step 100, for example by using the one button start switch in operator interface 47. The waste material is loaded into combustion chamber 25 through rear doors 26 as indicated by step 102. Then, in step 104, the burner units 32 and 34 are ignited, for example by using the keypad in operator interface 47 to enter a command that commences a burner ignition sequence, described below in connection with FIG. 6. After the burner units have been ignited, the operator checks for sustained combustion in step 106 by visual observation and/or sensor readings, and if combustion is sustained, the operator enters a command to minimize fuel flow to the burner units in accordance with step 108. At this stage, the system is ready for air curtain operation, which can be started under step 110 using the on/off button in the operator interface. Temperature information supplied by sensors 37 is read continuously under step 112 and evaluated under step 114 by burner controller 46. If the temperature is below a predetermined threshold, the burner controller 46 automatically increases fuel flow to burner units 32 and 34 pursuant to step 115; if not, the burner controller automatically minimizes fuel flow to the burner units according to step 116. Step 118 involves checking for more waste to burn. If there is more waste, it is added to combustion chamber 25 in step 119 and procedural flow resumes at step 112. If there is no more waste to burn, air curtain incinerator 10 is shut-off at step 120 to complete operation.

Figure 5:
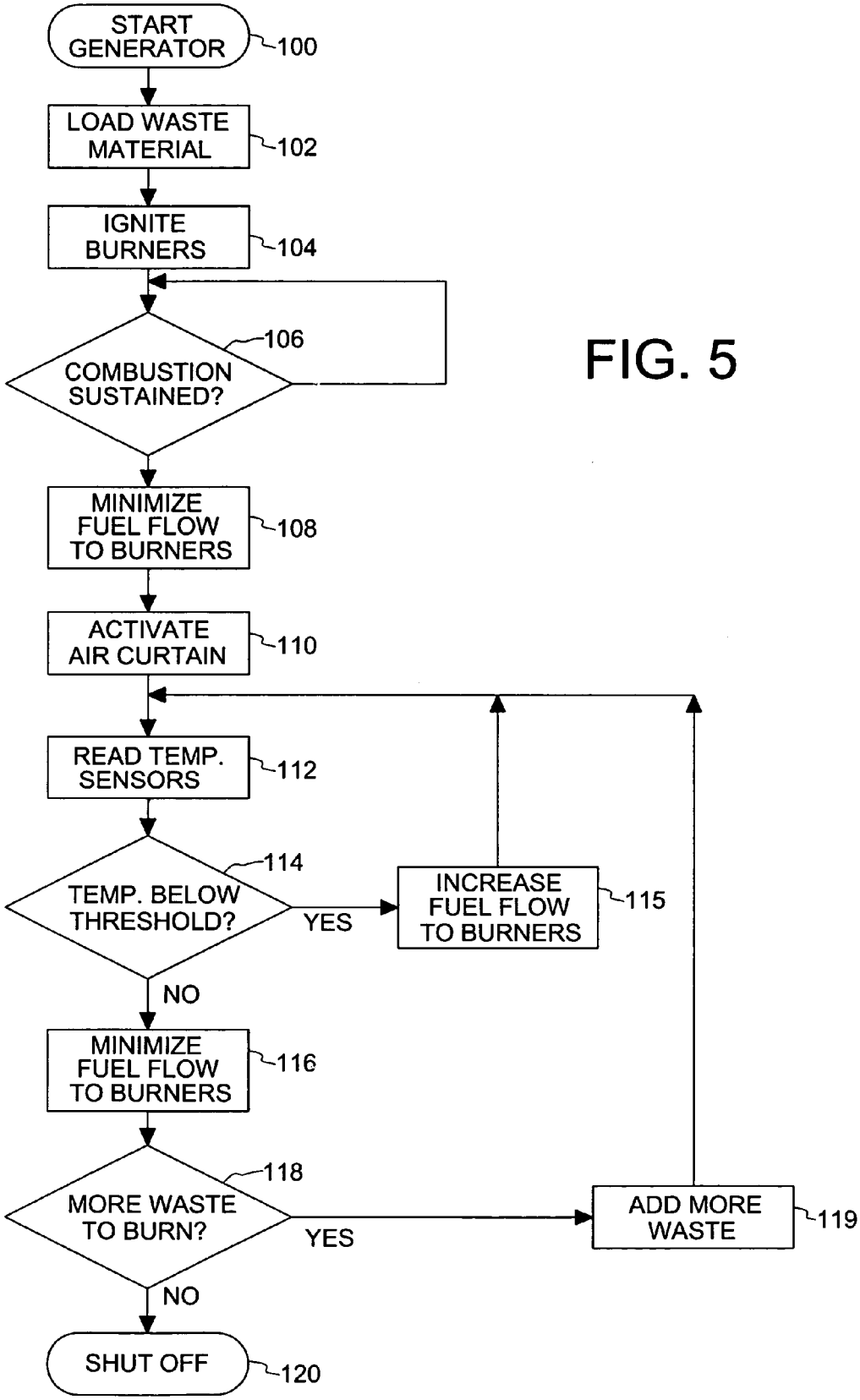
FIG. 5 is a flow diagram illustrating a procedure for operating the air curtain incinerator to burn waste.

It will be realized that the procedure illustrated in FIG. 5 assumes that temperature sensors are used to provide temperature feedback information to the burner controller, and that the burner controller is programmed to maintain a threshold temperature. However, a temperature readout may merely be displayed at operator interface 47 and the operator can adjust burner intensity based on the temperature readout to maintain a desired combustion temperature. Moreover, it is possible to incorporate opacity sensor information for burner feedback control if opacity sensors are provided, whereby burner intensity is increased if the particulate release rises to an unacceptable level.

Figure 6:
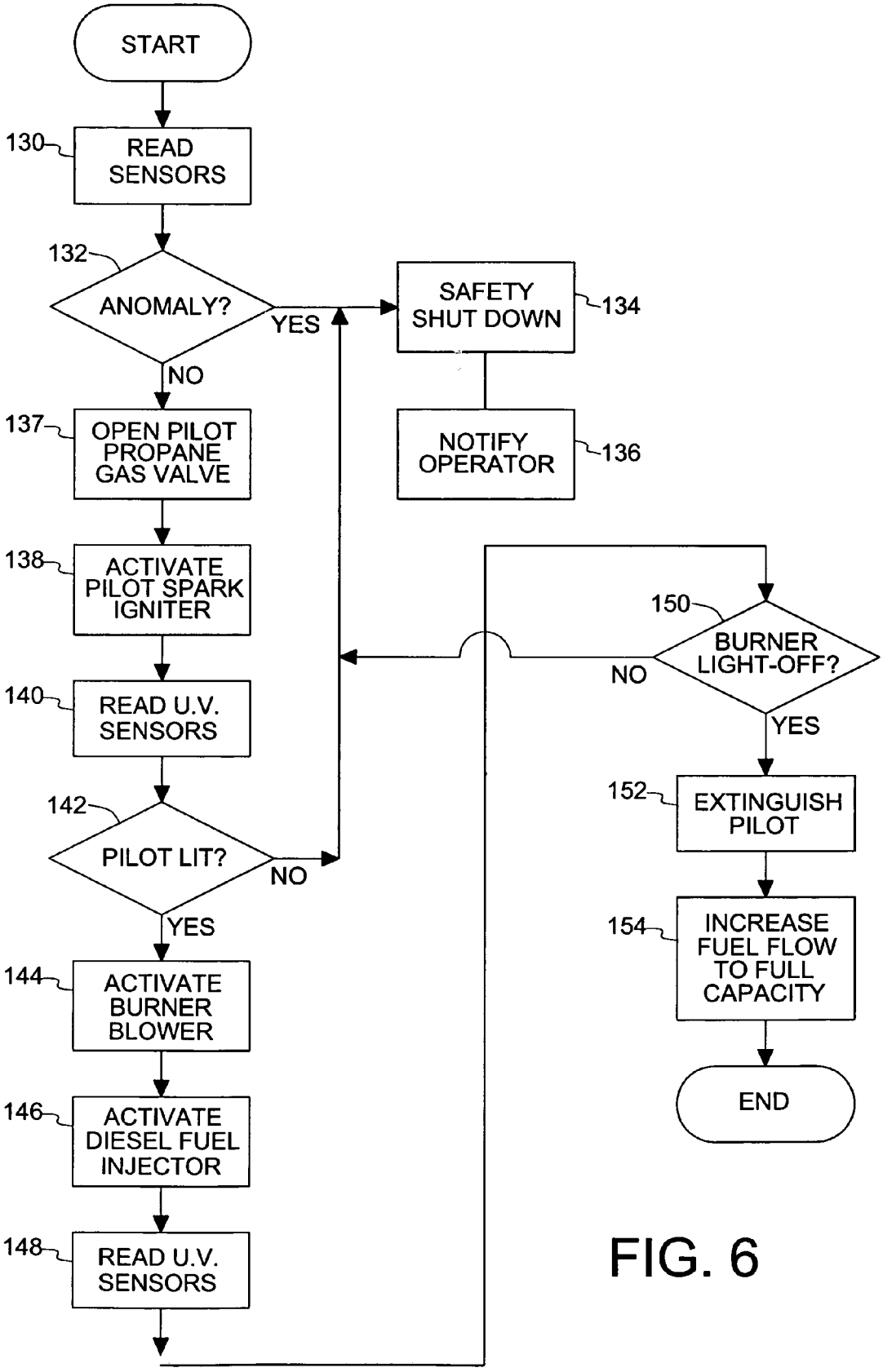
FIG. 6 is a flow diagram illustrating a burner unit ignition sequence of the air curtain incinerator.

FIG. 6 shows a preferred burner unit ignition sequence in detail. The ignition sequence begins at step 130 by reading all sensors of incinerator 10 and then checking for anomalies in the sensor readings at step 132. If any anomalies are found, a safety shut-off is triggered at step 134 and the operator is notified in step 136, for example by providing a malfunction message at operator interface 47. If the sensor check 130 reveals no anomalies, flow continues to steps 137 and 138, wherein a gas supply valve from propane tank 60 is opened and a pilot spark igniter is activated. Ultra-violet sensors provided with the burner unit are read at step 140 and the result is evaluated at step 142 to verify ignition of the propane-fueled pilot light. If the pilot light has failed to ignite, flow branches to safety shut-off and notification steps 134 and 136. If the pilot light has been successfully lit, then a blower and diesel fuel injector associated with the burner unit are activated according to steps 144 and 146. The UV sensors are again sampled and the readings evaluated in steps 148 and 150 to determine if burner light-off has been achieved. If not, flow branches back to safety shut-off 134 and operator notification 136. If burner light-off is confirmed in step 150, then the pilot light is extinguished in step 152 and fuel flow to the lit burner is increased to full capacity in step 154.

In a preferred embodiment of the invention, air curtain incinerator 10 is approximately forty feet long, thirteen feet wide, and twelve feet high, and it weighs approximately 60,000 lbs. Frame skids 18 and 20 permit the incinerator to be dragged along the ground up to one-half mile, and it can lifted or dragged onto a low deck trailer for transport across greater distances.

The air curtain incinerator 10 of the present invention represents an improvement over state of the art air curtain incineration systems, and is particularly well-suited for use in third-world countries where there is a lack of infrastructure for waste pickup and disposal. The air curtain incinerator described herein can be mobilized in and around large cities to reduce waste piles where disease and vermin thrive. The present invention is also well-suited for use at temporary and/or remote military installations, thereby eliminating the expense of flying the waste out on military transport planes.

What is claimed is:

1. A method of incinerating waste comprising the steps of:

providing a firebox, at least one fuel-burning burner unit for directing a flame into the firebox, and air curtain means for providing a sheet of high velocity air flow over a top opening of the firebox;

loading the firebox with waste;

activating the at least one burner unit until waste combustion is sustainable without energy from the at least one burner unit, and then deactivating the at least one burner unit to allow waste combustion to proceed on its own;

activating the air curtain means;

monitoring particulate release from the waste combustion;

reactivating the at least one burner unit if particulate release rises above an acceptable range, and then deactivating the at least one burner unit when particulate release is in the acceptable range.

2. The method according to claim 1, wherein the step of monitoring particulate release is performed visually using the Ringlemann smoke scale.

3. The method according to claim 1, wherein the step of monitoring particulate release is performed by one or more opacity sensors.

4. An incinerator apparatus comprising:

a frame, wherein the frame includes front and rear opposite ends, a pair of spaced skids extending from the front end to the rear end for contacting the ground, and a tow coupling at the front end;

a firebox supported on the frame, the firebox including an open top and a plurality of walls defining a combustion chamber;

a fuel supply tank supported on the frame;

a fuel-burning generator supported on the frame in communication with the fuel supply tank, the generator supplying electric power;

a fuel-burning burner unit in communication with the fuel supply tank, the burner unit being arranged to direct a flame into the combustion chamber; and air curtain means supported on the frame and powered by the generator for providing a sheet of high velocity air flow generally across the open top of the firebox; and a control room adjacent the firebox, wherein the fuel supply tank and the generator are housed in the control room.

5. The apparatus according to claim 4, wherein the control room is proximate to the front end of the frame.

6. The apparatus according to claim 4, further comprising an automatic fuel injector regulating flow of fuel to the burner unit and a controller connected to the fuel injector, whereby output intensity of the burner unit is adjustable by the controller.

7. The apparatus according to claim 6, further comprising at least one sensor connected to the controller for providing feedback to the controller for automatically adjusting the output intensity of the burner unit.

8. The apparatus according to claim 7, wherein the at least one sensor includes a temperature sensor measuring temperature in the firebox.

9. The apparatus according to claim 7, wherein the at least one sensor includes an opacity sensor measuring the opacity of smoke from combustion of the waste material.

10. The apparatus according to claim 6, wherein the controller is housed in the control room.

11. The apparatus according to claim 10, further comprising an operator interface in the control room in communication with the controller for enabling an operator to enter commands to the controller.

12. The apparatus according to claim 10, wherein the burner unit is located remotely from the control room.

13. The apparatus according to claim 10, wherein a plurality of burner units are provided.

14. The apparatus according to claim 13, wherein at least one of the plurality of burner units is located remotely from the control room.

15. The apparatus according to claim 13, wherein at least one of the plurality of burner units is located adjacent to the control room.

* * * * *